United States Patent [19]

VanSon et al.

[11] 4,007,348

[45] Feb. 8, 1977

[54] SPRING CONTACT ASSEMBLY

[75] Inventors: Darryl Jay VanSon, Brookfield; Kent Gordon Blackman, Sycamore, both of Ill.

[73] Assignee: GTE Automatic Electric Laboratories Incorporated, Northlake, Ill.

[22] Filed: Dec. 24, 1975

[21] Appl. No.: 644,361

[52] U.S. Cl. ..... 200/283; 200/153 M

[51] Int. Cl.[2] ..... H01H 15/02

[58] Field of Search ..... 200/153 M, 283, 275, 200/292

[56] References Cited

UNITED STATES PATENTS

| | | | |
|---|---|---|---|
| 2,903,540 | 9/1959 | Gloviak et al. | 200/153 M |
| 3,944,760 | 3/1976 | Zdanys et al. | 200/153 M |

*Primary Examiner*—Herman Hohauser
*Attorney, Agent, or Firm*—Robert J. Black

[57] ABSTRACT

A spring contact assembly formed of a pair of spring contacts and an actuator which is supported by and slidably retained on the spring contacts in a fashion such that the actuator is both self-guided by the spring contacts and is longitudinally movable lengthwise of the spring contacts to open and close them.

7 Claims, 4 Drawing Figures

FIG. 1
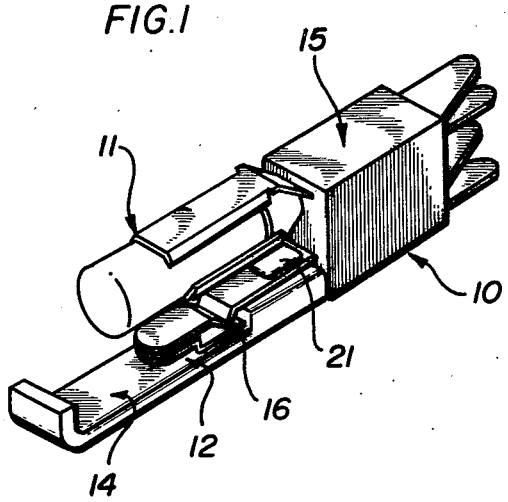
FIG. 2
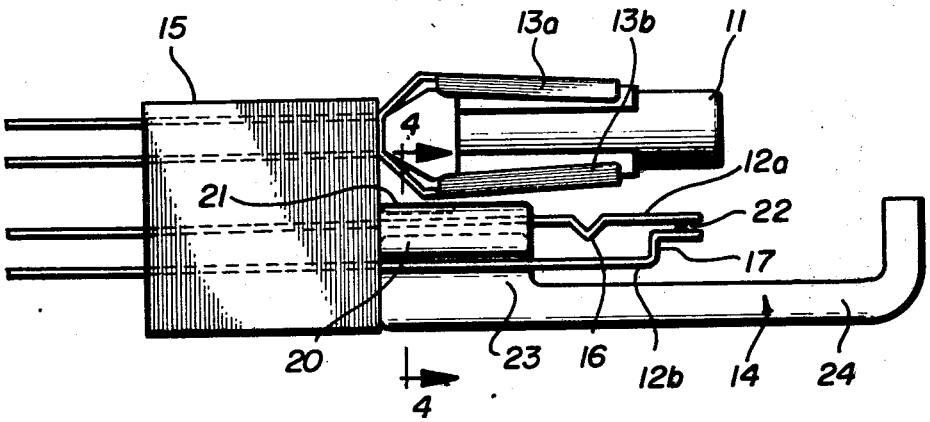
FIG. 3
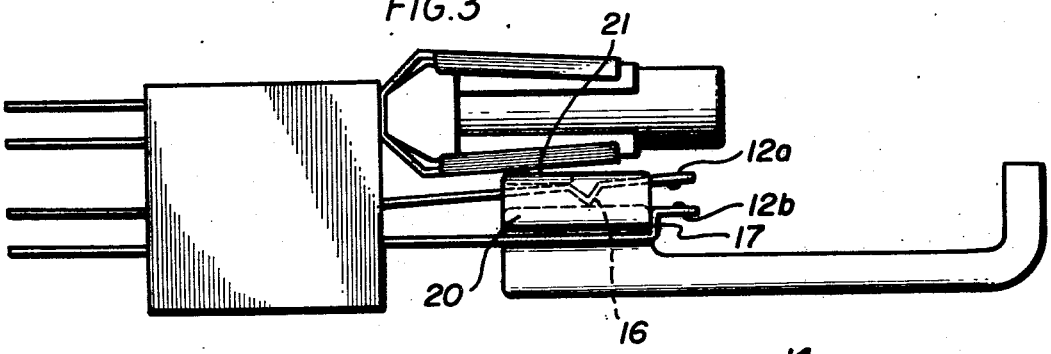
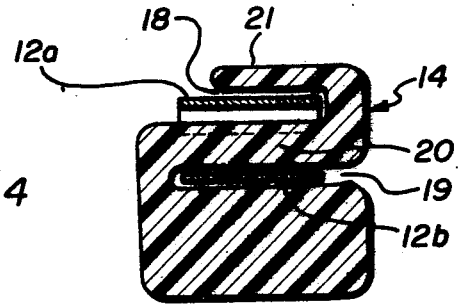
FIG. 4

SPRING CONTACT ASSEMBLY

BACKGROUND OF THE INVENTION

This invention relates to an improved spring contact assembly including a self-guided spring contact actuator.

There are various occasions when an inexpensive, simple spring contact assembly, which can be easily operated to hold a pair of contacts open until it is again operated to close the contacts, is required. Such an assembly is required, for example, for use in a test jack assembly to "busy" switches in a telephone system.

SUMMARY OF THE INVENTION

The spring contact assembly of the present invention is formed of a pair of spring contacts and an actuator which is supported by and slidably retained on the spring contacts in a fashion such that the actuator is both self-guided by the spring contacts and is longitudinally movable lengthwise of the spring contacts to open and close them.

Accordingly, it is an object of the present invention to provide an improved spring contact assembly including a self-guided spring contact actuator.

Other objects of the invention will appear in the following description and appended claims, reference being had to the accompanying drawing forming a part of this specification wherein like reference characters designate corresponding parts in the several views.

BRIEF DESCRIPTION OF THE DRAWINGS

FIG. 1 is a perspective view of a spring contact assembly exemplary of the invention;

FIG. 2 is a side plan view of the spring contact assembly, with the spring contacts in the closed position;

FIG. 3 is a side plan view of the spring contact assembly illustrating the manner in which the actuator is longitudinally moved lengthwise of the spring contacts to open them; and FIG. 4 is a sectional view taken along lines 4-4 of FIG. 2.

DESCRIPTION OF THE PREFERRED EMBODIMENT

Referring now to the drawing, in FIG. 1 there is shown a spring contact assembly 10 exemplary of the present invention, including a pair of spring contacts 12*a* and 12*b* and an actuator 14. In the illustrated embodiment, the spring contact assembly 10 further is shown to include a lamp 11, however, the lamp 11 may or may not be provided, as desired. The lamp 11, as can be best seen in FIG. 2, is removably supported and retained between a pair of jack spring contacts 13*a* and 13*b*, the ends of which are formed and extended through a support or mounting block 15 in a fashion such as to provide a pair of plug-in terminals. Correspondingly, the pair of spring contacts 12*a* and 12*b* are extended through the support or mounting block 15 and likewise provide a pair of plug-in terminals. The support or mounting block 15 can be adapted to be secured to a supporting structure, in any convenient fashion.

As indicated above, the essence of the present invention is the pair of spring contacts 12*a* and 12*b*, and the actuator 14 which is supported by and slidably retained on the spring contacts in a fashion such that the actuator 14 is both self-guided by the spring contacts and is longitudinally movable lengthwise of the spring contacts to open and close them. The pair of spring contacts 12*a* and 12*b* are disposed and supported by the support or mounting block 15 in substantially parallel, spaced apart relationship, so that the respective contacts 22 on the end thereof are normally closed. One of the spring contacts, spring contact 12*a* in the illustrated embodiment, has a cam 16 on it and the other one of the spring contacts, the spring contact 12*b* in the illustrated embodiment has a stop 17 on it. While various types of cams 16 can be provided on the spring contact 12*a*, preferably and advantageously the cam 16 is provided by simply forming a generally V-shaped bend in the spring contact so that the cam 16 is integral with the spring contact. Also, the stop 17 preferably and advantageously is provided by simply forming a generally L-shaped bend in the spring contact 12*b*, which functions as a shoulder or stop 17.

The actuator 14 preferably and advantageously is molded of a plastic or other insulating material, and includes a body portion 23 which can be generally rectangular shaped and an elongated handle portion 24 which extends from and is integral with the body portion 23. The body portion 23, as can be best seen in FIG. 4, has a pair of slots 18 and 19 formed in it, with the respective ones of the slots 18 and 19 extending into the body portion from each of the opposite sides of it so that a generally S-shaped cross section results. As can be best seen in FIGS. 1–3, the top wall 21 of the body portion 23 terminates short of the length of the body portion 23, the top wall 21 being substantially one-half the length of the body portion 21, as illustrated. Also, the top wall 21 can be narrower in width than the the width of the body portion 23.

In assembling the spring contact assembly 10, the spring contact 12*a* is slidably retained within the slot 18 and the spring contact 12*b* is slidably retained within the slot 19. With this arrangement, it may be noted that the resulting vertical side wall at the ends of the slots 18 and 19 being in opposed relationship with respect to one another and the body portion 23 prevent the actuator 14 from being moved transversely with respect to the spring contacts 12*a* and 12*b*, and therefore function as guides for retaining the actuator 14 on the spring contacts 12*a* and 12*b*. The terminal portion of the handle 14 can be bent upwardly, as illustrated, to provide an upstanding grip which can be utilized in manipulating the actuator 14.

The spring contacts 12*a* and 12*b* and the actuator 14 are assembled as illustrated in FIGS. 1 and 2, and it can be seen that the slots 18 and 19 in the body portion 23 of the actuator 14 are disposed and arranged such that the contacts 12*a* and 12*b* are normally closed, with the actuator 14 positioned as illustrated in FIG. 2. To open the contacts 22 on the spring contacts 12*a* and 12*b*, the actuator 14 is simply moved longitudinally lengthwise of the spring contacts so that the leading edge of the portion 21 between the spring contacts 12*a* and 12*b* engage the cam 16 on the spring contact 12*a*. As the actuator 14 is further moved longitudinally lengthwise of the spring contacts 12*a* and 12*b*, the cam 16 is cammed upwardly and eventually rides atop of the surface of the portion 20, and thereby opens the contacts 22 on the spring contacts 12*a* and 12*b*, as can be best seen in FIG. 3. The absence of the top wall 21 permits the spring contact 12*a* to spring upwardly as the cam 16 rides along the top surface of the portion 20. When the actuator 14, i.e. the forward edge of the body portion 23 thereof, engages against the stop 17 on the spring contact 12*b*, additional forward movement of the actuator 14 is prevented.

The spring contacts 12*a* and 12*b* will remain open, so long as the actuator 14 is positioned, as illustrated in FIG. 3, with the cam 16 engaged with the top surface of the portion 20 of the body portion 23. The spring tension of the spring contact 12*a* functions to assist in keeping the actuator 14 from moving longitudinally with respect to the spring contacts 12*a* and 12*b*, so that the spring contacts are held open until the actuator is again operated to close the contacts. In the latter event, obviously the actuator 14 is moved rearwardly longitudinally lengthwise of the spring contacts 12*a* and 12*b* to disengage the cam 16 from the portion 20 of the body portion 23, to the position generally illustrated in FIG. 2.

In the event the spring contact assembly 10 also includes a lamp 11, as illustrated, it may be noted that the top wall 21 also functions to insulate the contact 12*a* from the metallic jack spring contacts 13 supporting the lamp 11.

Accordingly, as can be seen from the above description a very simple, inexpensive spring contact assembly having a self-guide spring contact actuator is provided. To open the normally closed contacts 22 on the spring contacts 12*a* and 12*b*, the actuator 14 is simply longitudinally moved lengthwise of the spring contacts to engage the edge of the portion of the body portion 23 with a cam 16 on the spring contact 12*a*. Correspondingly, to close the contacts 22 on the spring contacts 12*a* and 12*b*, the actuator 14 simply is longitudinally moved in the opposite direction.

It will thus be seen that the objects set forth above, among those made apparent from the preceding description, are efficiently attained and certain changes may be made in the above construction. Accordingly, it is intended that all matter contained in the above description or shown in the accompanying drawing shall be interpreted as illustrative and not in a limiting sense.

Now that the invention has been described, what is claimed as new and desired to be secured by Letters Patent is:

1. A spring contact assembly comprising a pair of substantially parallel spring contacts which are normally closed, at least one of said pair of spring contacts having a cam on it; and an actuator slidably supported by said pair of spring contacts, said actuator having a portion thereof disposed between said pair of spring contacts and forming a cam surface which engages said cam on said one spring contact to open said pair of spring contacts when said actuator is slidably translated longitudinally along the length of said pair of spring contacts.

2. The spring contact assembly contact assembly of claim 1, wherein said cam is formed on said one spring contact by forming a generally V-shaped bend in it, whereby said cam is an integral part of said one spring contact.

3. The spring contact assembly of claim 1, wherein said actuator further comprises an extended portion forming a handle for slidably translating said actuator along the length of said pair of spring contacts.

4. The spring contact assembly of claim 1, wherein said actuator further comprises wall portions which are vertically disposed in spaced apart relationship on opposite sides of said pair of spring contacts, with each of said wall portions being slidably engageable by one of said pair of spring contacts, said wall portions functioning as guides for said actuator and slidably securing said actuator to said pair of spring contacts.

5. The spring contact assembly of claim 1, wherein said actuator comprises a body portion having a pair of spaced apart slots formed in it which extend into said body portion from the opposite sides thereof, one of said pair of spring contacts being slidably disposed in and extended through the respective ones of said slots, the portion of said body portion between said pair of spaced apart slots being disposed between said pair of spring contacts and the edge thereof forming said cam surface engageable with said cam on said one spring contact, and an extended portion integral with said body portion forming a handle.

6. The spring contact assembly of claim 1, wherein one of said pair of spring contacts has a cam formed on it and the other one thereof has a stop formed on it, said stop being engageable by said actuator to prevent it from being disengaged from said pair of spring contacts.

7. The spring contact assembly of claim 6, wherein said cam is formed on said one spring contact by forming a generally V-shaped bend in it so that said cam is integral with said spring contact, and wherein said stop is formed on the other one of said spring contacts by forming a generally L-shaped bend in said spring contact to provide an abutment which is engageable by said actuator so that said stop is integral with said other one of said spring contacts.

* * * * *